US008089261B2

(12) United States Patent
Lipka

(10) Patent No.: US 8,089,261 B2
(45) Date of Patent: Jan. 3, 2012

(54) LOW DROPOUT REGULATOR COMPENSATION CIRCUIT USING A LOAD CURRENT TRACKING ZERO CIRCUIT

(75) Inventor: Ronald J. Lipka, Fort Collins, CO (US)

(73) Assignee: LSI Corporation, Milpitas, CA (US)

( * ) Notice: Subject to any disclaimer, the term of this patent is extended or adjusted under 35 U.S.C. 154(b) by 128 days.

(21) Appl. No.: 12/465,521

(22) Filed: May 13, 2009

(65) Prior Publication Data

US 2010/0289475 A1 Nov. 18, 2010

(51) Int. Cl.
*G05F 3/16* (2006.01)
*G05F 3/20* (2006.01)

(52) U.S. Cl. ..... 323/315

(58) Field of Classification Search ..... 323/312–316
See application file for complete search history.

(56) References Cited

U.S. PATENT DOCUMENTS 7,129,686 B1 * 10/2006 Huang ..... 323/315
7,746,047 B2 * 6/2010 Yin et al. ..... 323/315

OTHER PUBLICATIONS

Chava et al., "A Frequency Compensation Scheme for LDO Voltage Regulators", Jun. 6, 2004, IEEE Transactions on Circuits & Systems, vol. 51, 1041-1050.*
"A Frequency Compensation Scheme for LDO Voltage Regulators" Chava, Chaitanya K. and Silva-Martinez, Jose, IEEE Transactions on Circuits & Systems, vol. 51, No. 6, Jun. 2004.

* cited by examiner

*Primary Examiner* — Jue Zhang
(74) *Attorney, Agent, or Firm* — William W. Cochran; Cochran Freund & Young LLC

(57) ABSTRACT

Disclosed is a low dropout regulator that uses a load current tracking zero circuit to stabilize a feedback loop to prevent oscillations. The load current tracking zero circuit senses the DC component of the current flowing through the pass transistor of the low dropout regulator and uses the pass transistor current signal to control a multiplicative factor. The multiplicative factor multiplies the AC variations in the output voltage to generate the zero current.

4 Claims, 2 Drawing Sheets

LOW DROPOUT REGULATOR COMPENSATION CIRCUIT USING A LOAD CURRENT TRACKING ZERO CIRCUIT

BACKGROUND OF THE INVENTION

Low dropout (LDO) regulators are useful in applications where the regulator output voltage is not much lower than the input voltage, low power supply noise is required, and regulator power efficiency is not important. A low dropout voltage is achievable because the pass transistor in an LDO linear voltage regulator is a single transistor which can be driven very close to the triode region of operation. As a result, the dropout voltage, which is the minimum required voltage difference from the input to the output, is the lowest of any linear regulator type. Hence, low dropout regulators are useful in many circuits.

SUMMARY OF THE INVENTION

An embodiment of the present invention may therefore comprise a method of stabilizing a feedback control loop in a low dropout voltage regulator comprising: detecting changes in a gate voltage at a gate of a pass transistor that results from changes in load current flowing in a load that is driven by the pass transistor; controlling a current mirror ratio of a current mirror based upon the changes in the gate voltage; detecting an output voltage that is applied to the load; controlling current flow in the first leg of a load current tracking zero circuit, connected to the current mirror, by applying the output voltage to a gate of a source follower buffer disposed in the first leg; generating current flow in a second leg of the load current tracking zero circuit, connected to the current mirror, that is a mirror of the current in the first circuit, but that is amplified by the current mirror ratio; extracting a bias current component of the current flow in the second leg of the circuit, which is equal to a bias current generated in the first leg multiplied by the current mirror ratio, to generate an error current signal that varies with the load current; applying the error current signal to the feedback control loop to stabilize the feedback loop.

An embodiment of the present invention may further comprise a low dropout voltage regulator having a feedback control loop that uses a zero current to stabilize the feedback control loop comprising: a pass transistor having a pass transistor gate that is connected to a gate voltage node in the feedback control loop, the pass transistor controlling an output voltage that is applied to a load by controlling load current applied to the load in response to a gate voltage on the gate node; a source follower buffer disposed in a first leg of a load current tracking zero circuit that has a source follower gate that is connected to the output voltage so that current in the first leg is controlled by the output voltage; a second leg of the load current tracking zero circuit; a current mirror that is connected to a gate voltage node having a gate voltage, the current mirror generating a current mirror ratio (K) in response to the gate voltage, the current mirror further connected to the first leg and the second leg of the load current tracking zero circuit that generates a current flow in the second leg that is a mirror of current flowing in the first leg, but that is amplified by the current mirror ratio to produce a zero current signal; an error amplifier having a positive input that is connected to the zero current signal and a negative input connected to a reference voltage that compares the reference voltage to the output voltage, and generates the gate voltage as an error amplifier output signal.

DETAILED DESCRIPTION OF THE EMBODIMENTS

Figure 1:
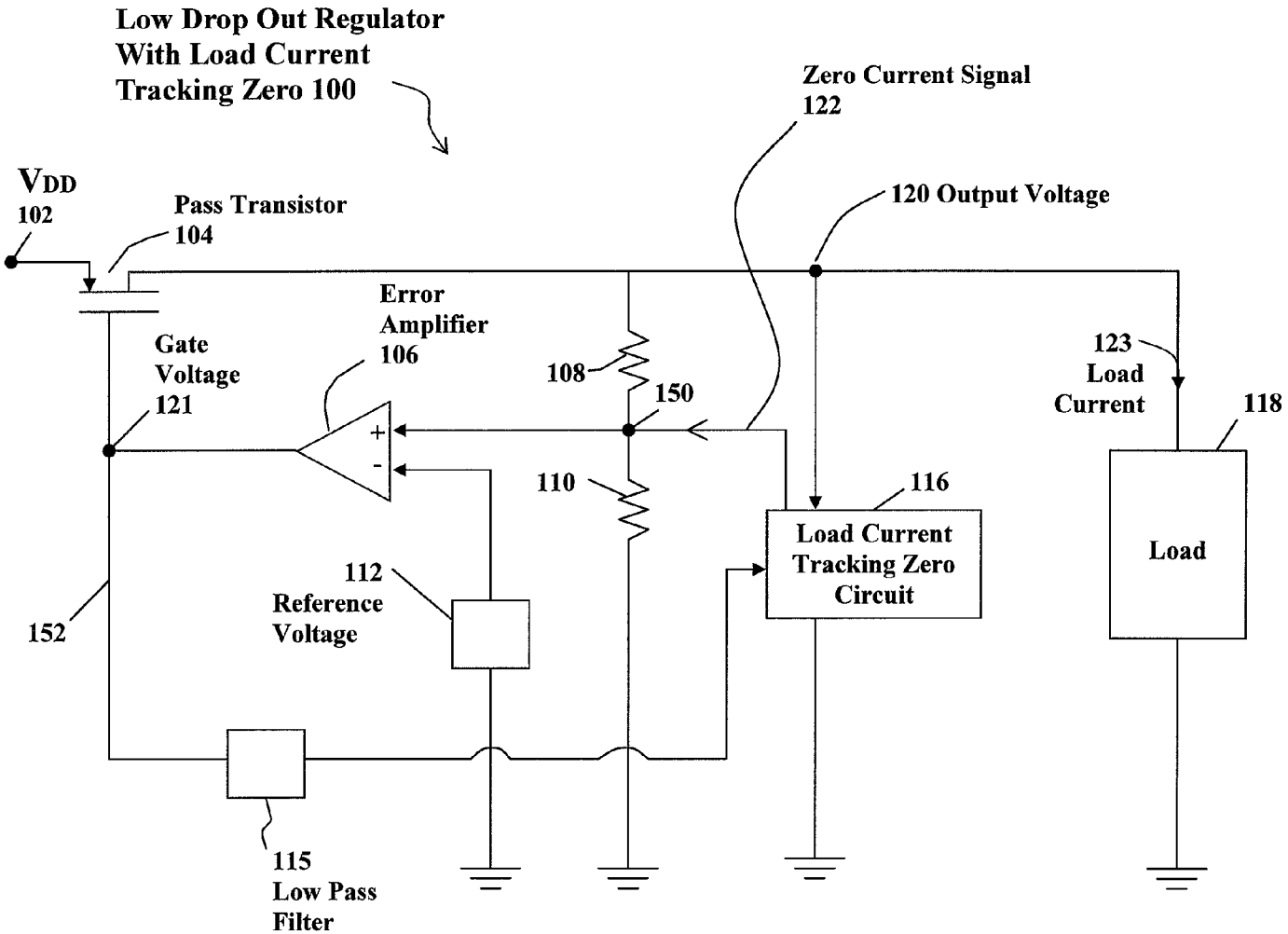
FIG. 1 is a schematic block diagram of a low dropout regulator circuit that utilizes a load current tracking zero circuit.

FIG. 1 is a schematic block diagram of a low dropout regulator circuit 100 that utilizes a load current tracking zero circuit 116. As shown in FIG. 1, a supply voltage (VDD) 102 is provided to the low dropout regulator 100, which generates an output voltage 120. The supply voltage 102 may be a voltage that is supplied externally from a different circuit, or generated within the same chip. The low dropout regulator 100 is used to regulate the output voltage 120, based upon the supply voltage 102, to maintain a predetermined voltage level at the output voltage 120 for various loads, such as load 118. Load 118 may comprise a simple single pole load or, in some circuits, may comprise a more complex multiple poles and/or zeros load. In order to maintain a stable feedback loop, it is often necessary to inject a zero current signal in the error amplifier 106 to stabilize the feedback loop. The phase and amplitude of the zero current signal 122 will necessarily change as the load 118 changes. The load changes because the demand of the circuits that comprise the load 118 changes. As the load 118 changes, the poles also change. Since the load current 123 through the load 118 is changing, the phase margin also changes as a result of the pole changing.

To maintain greater stability in the feedback circuit, it is therefore advantageous to generate a zero current signal, such as zero current signal 122, that changes with the load current 123. If the zero current 122 does not track the load current 123, the zero current 122 must be designed for a worst case scenario, which results in overdesigning of the circuit. Hence, the use of a zero current signal 122, that tracks the load current 123, provides a stable feedback circuit that remains stable over a wide range of load currents 123.

As shown in FIG. 1, the gate of the pass transistor 104 is controlled by the gate voltage 121. As the load current 123 increases, the gate voltage 121 drops, since pass transistor 104 is a PMOS transistor. The positive input to error amplifier 106 is connected to node 150 which is the output voltage 120 that is divided by resistor divider circuit 108, 110, and to zero current signal 122. The input at node 150, which is applied to the positive input of the error amplifier 106, is compared to a reference voltage 112. Error amplifier 106 then controls the gate voltage 121 of pass transistor 104 based upon the difference between the reference voltage 112 and the input applied to the positive input of the error amplifier 106. The gate voltage 121 is applied to load current tracking zero circuit 116 via low pass filter 115 to control a current amplifier in the load current tracking zero circuit 116, as explained more fully with respect to FIG. 2. Output voltage 120 is also applied to the load current tracking zero circuit 116, which is used by the load current tracking zero circuit 116 to generate the zero current 122 that is applied to the positive input of error amplifier 106 in the control feedback loop of the low dropout regulator 100.

Figure 2:
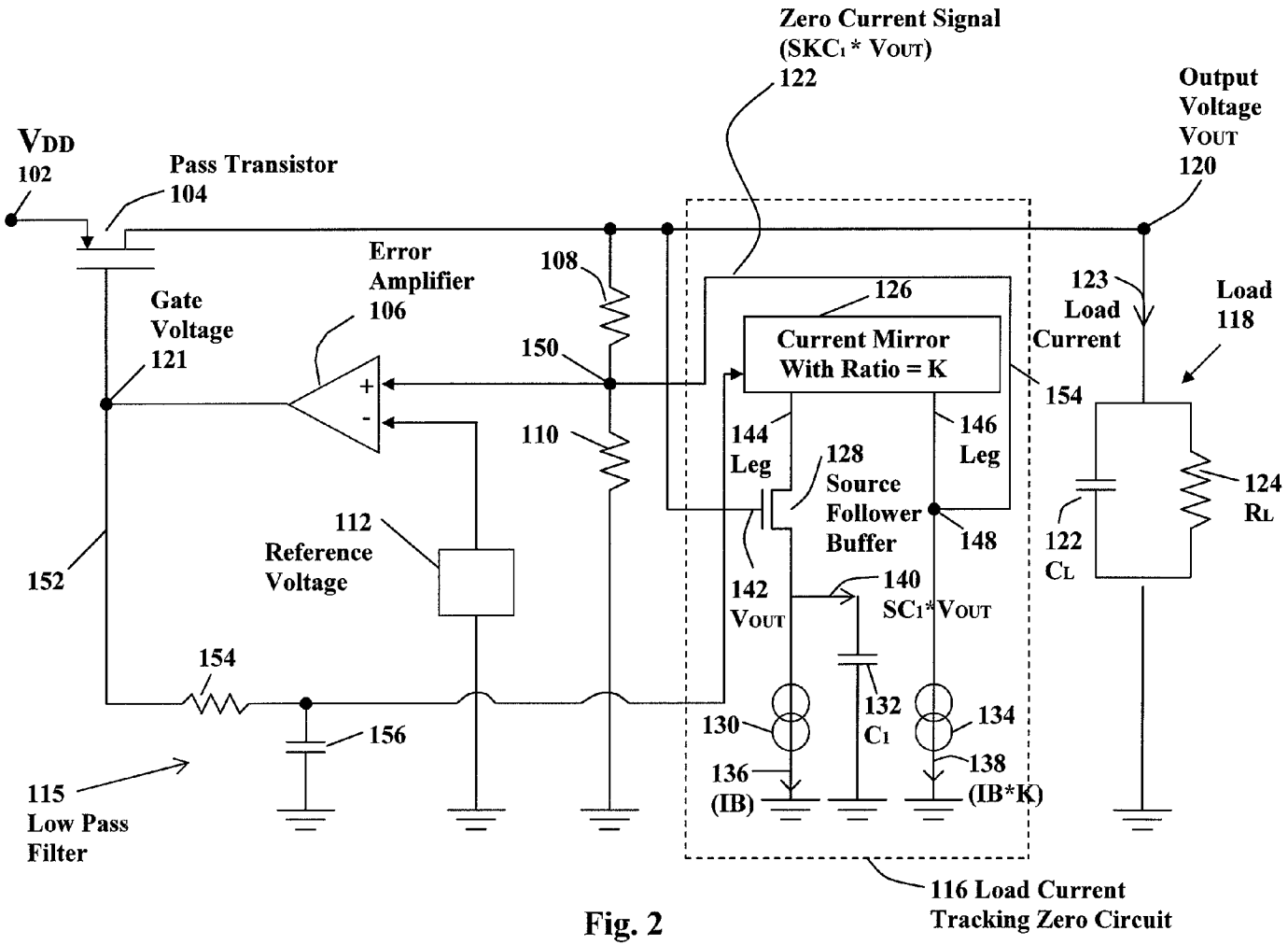
FIG. 2 is a more detailed diagram of the embodiment of FIG. 1.

FIG. 2 is a more detailed block diagram of the embodiment of FIG. 1. Again, VDD 102 is supplied to the low dropout regulator 100 from another circuit, such as another circuit on a circuit board. The pass transistor 104 controls the output voltage ($V_{OUT}$) 120 and supplies current to the output based upon the gate voltage 121. Error amplifier 106 controls the gate voltage 121 by comparing the input on node 150 to a reference voltage 112. The load current tracking zero circuit 116 includes a current mirror 126 that mirrors current in each of the circuit legs 144, 146 that are connected to the current mirror 126. However, the current in leg 146 is a factor of K greater than the current in leg 144. The multiplicative factor K is controlled by the gate voltage 121 that is supplied by connector 152, which is low pass filtered by low pass filter 115 to provide the DC component of the gate voltage 121. Low pass filter may comprise a series connected resistor 154 and a capacitor 156 connected to ground. When the load current 123 increases, the impedance of the load has decreased, which increases the load pole frequency. This necessitates the application of more current through the pass transistor 104, resulting in a drop in the gate voltage 121 since the pass transistor 104 is a PMOS type transistor. The gate voltage 121 is applied to the current mirror 126 that modifies the multiplicative factor K in response to said gate voltage 121. The multiplicative factor K varies proportionally to the gate voltage 121. The adjustability of the multiplicative factor K is implemented by adding PMOS degeneration resistors (not shown) on both sides of the current mirror, between PMOS current mirror sources and VDD. The gate voltage of the current mirror input leg degeneration device (not shown) is controlled by the DC component of the gate voltage 121 and the gate voltage of the current mirror output leg degeneration device (not shown) is fixed at a midpoint DC bias voltage. When gate voltage 121 decreases because of an increase in load current, then the current mirror input leg degeneration resistance decreases, which increases K and, in turn, increases the zero frequency. The opposite happens when the load current decreases. Also, the degeneration device (not shown) is implemented with the same type and channel length PMOS device as the pass transistor 104 to cancel process variations.

As also shown in FIG. 2, the current in leg 144 is controlled by the source follower buffer 128. The gate of the source follower buffer 128 is coupled to the output voltage 120. Current source 130 provides a bias current (IB) to bias the source follower buffer 128. As the output voltage 120 varies, the current through the source follower buffer 128 also varies. The AC component of the current in leg 144, which is equal to $SC1*V_{OUT}$, is shunted to ground through capacitor C1. The current in leg 144 is mirrored in leg 146, but multiplied by the variable factor K, which varies in accordance with the gate voltage 121, as disclosed above. Current source 134 generates a DC current that is equal to the DC bias current (IB) generated by current source 130. Hence, the current generated by current source 134 is a DC current that is equal to IB*K. Since the DC current IB*K 138 is subtracted from the current on leg 146, at node 148, the zero current signal on connector 154 constitutes the AC component of the current on leg 144 multiplied by the variable factor K. Hence, zero current 122 is $=SKC1*V_{OUT}$, where C1 is capacitor 132, K is the variable ratio factor of the current mirror 126, $V_{OUT}$ is the output voltage 120 and S is $j*\omega$, where j is the square root of −1 and $\omega$ is the angular frequency in radians. The zero current signal 122 is applied to node 150 that is connected to the positive input of the error amplifier 106. Error amplifier 106 generates an error signal based upon the difference between the positive input to error amplifier 106 and a reference voltage 112 applied to the negative input of error amplifier 106. Hence, the zero current signal 122 tracks changes in the load current 123 by detecting variations in the output voltage, as well as changes in the amount of current that passes through pass transistor 104. The multiplicative factor K varies proportionally with the change in the current passing through pass transistor 104, which is substantially equal to the load current 123. AC variations of the output voltage 120 are multiplied by the variable multiplicative factor K to generate the zero current signal 122. The zero current signal is applied to the feedback path at node 150 and stabilizes the control circuit to prevent oscillations.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A method of stabilizing a feedback control loop in a low dropout voltage regulator comprising:

detecting changes in a gate voltage at a gate of a pass transistor that results from changes in load current flowing in a load that is driven by said pass transistor;

controlling a current mirror ratio of a current mirror based upon said changes in said gate voltage;

detecting an output voltage that is applied to said load;

controlling current flow in said first leg of a load current tracking zero circuit, connected to said current mirror, by applying said output voltage to a gate of a source follower buffer disposed in said first leg;

generating current flow in a second leg of said load current tracking zero circuit, connected to said current mirror, that is a mirror of said current flow in said first circuit, but that is amplified by said current mirror ratio;

extracting a bias current component of said current flow in said second leg of said circuit, which is equal to a bias current generated in said first leg multiplied by said current mirror ratio, to generate an error current signal that varies with said load current;

applying said error current signal to said feedback control loop to provide a current signal that generates a zero current in said feedback loop to stabilize said feedback loop.

2. The method of claim 1 further comprising:

providing an error amplifier in said feedback control loop that compares said zero current and said output voltage with a reference voltage current to generate said gate voltage of said gate of said pass transistor that is connected to said output of said error amplifier.

3. A low dropout voltage regulator having a feedback control loop that uses a zero current to stabilize said feedback control loop comprising:

a pass transistor having a pass transistor gate that is connected to a gate voltage node in said feedback control loop, said pass transistor controlling an output voltage that is applied to a load by controlling load current applied to said load in response to a pass transistor gate voltage on said gate voltage node;

a source follower buffer disposed in a first leg of a load current tracking zero circuit that has a source follower gate that is connected to said output voltage so that current in said first leg is controlled by said output voltage;

a second leg of said load current tracking zero circuit;

a current mirror that is connected to said gate voltage node of said pass transistor having a pass transistor gate voltage, said current mirror generating a current mirror ratio (K) in response to said pass transistor gate voltage, so that said current mirror ratio changes with said pass transistor gate voltage, said current mirror further connected to said first leg and said second leg of said load current tracking zero circuit that generates a current flow in said second leg that is a mirror of current flowing in said first leg, but that is amplified by said current mirror ratio (K) to produce a current signal that generates a zero current in said feedback loop;

an error amplifier having a positive input that is connected to said current signal in said second leg that generates a zero current in said feedback loop and a negative input connected to a reference voltage that compares said reference voltage to said output voltage, and generates said pass transistor gate voltage as an error amplifier output signal.

4. The low dropout voltage regulator of claim 3 further comprising:

a first bias current source in said first leg of said load current tracking zero circuit that generates a bias current IB in said first leg;

a second bias current source in said second leg of said load current tracking zero circuit that generates a bias current K*IB in said second leg.

* * * * *